US007472462B1

(12) United States Patent
Parker et al.

(10) Patent No.: US 7,472,462 B1
(45) Date of Patent: Jan. 6, 2009

(54) DECORATIVE COVER FOR CASKET SHELL FLANGE

(75) Inventors: Daniel J. Parker, Connersville, IN (US); Angela K. Topper, Greensburg, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 11/936,979

(22) Filed: Nov. 8, 2007

(51) Int. Cl.
*A61G 17/00* (2006.01)

(52) U.S. Cl. ..... 27/19

(58) Field of Classification Search ..... 27/19, 27/2, 4, 6, 7, 17; 248/345.1; D99/8, 10
See application file for complete search history.

(56) References Cited

U.S. PATENT DOCUMENTS

| | | | | |
|---|---|---|---|---|
| 1,500,141 | A | 7/1924 | MacDonald | |
| 1,977,584 | A | 10/1934 | Hansen | |
| 2,250,704 | A | 7/1941 | Donnelly | |
| 2,943,376 | A | 7/1960 | Bashuk | |
| 3,218,688 | A | 11/1965 | Slaughter | |
| 3,233,302 | A | 2/1966 | Ross | |
| 3,810,281 | A | 5/1974 | Ferber | |
| 3,892,417 | A | 7/1975 | Clayton | |
| 4,003,109 | A | 1/1977 | Matichak | |
| 4,882,821 | A | 11/1989 | Sims, Jr. | |
| 4,930,197 | A | 6/1990 | McClive | |
| 5,508,078 | A * | 4/1996 | Stalnaker | 428/71 |
| 5,639,072 | A | 6/1997 | McCall | |
| 5,740,592 | A | 4/1998 | Lau | |
| 5,970,590 | A | 10/1999 | Tambussi | |
| 5,974,640 | A | 11/1999 | Vosahlik et al. | |
| 6,019,336 | A | 2/2000 | Havens | |
| 6,125,488 | A * | 10/2000 | Vogland et al. | 5/739 |
| 6,378,831 | B1 | 4/2002 | Copeland, Jr. | |
| 6,438,249 | B1 | 8/2002 | Wiener | |
| 7,069,627 | B2 | 7/2006 | Cunningham et al. | |
| 7,272,875 | B2 | 9/2007 | Bovard et al. | |

FOREIGN PATENT DOCUMENTS

| | | |
|---|---|---|
| EP | 0776619 | 6/1997 |

* cited by examiner

*Primary Examiner*—William L. Miller
(74) *Attorney, Agent, or Firm*—Wood, Herron & Evans, L.L.P.

(57) ABSTRACT

A casket comprises a shell having a pair of opposed side walls and a pair of opposed end walls, the walls defining an upwardly facing flange of the shell, a lid closeable upon the flange of the shell, and a cover removably positioned on the shell when the lid is open, the cover being constructed of a first section which overlies the flange and a second section which overlies a portion of the shell side and end walls extending downward from the flange, the first and second sections being joined along lengths thereof by a third malleable section which functions as a stave thereby permitting an angle formed between the first and second sections to be manually adjusted and set.

8 Claims, 3 Drawing Sheets

DECORATIVE COVER FOR CASKET SHELL FLANGE

FIELD

Figure 1:
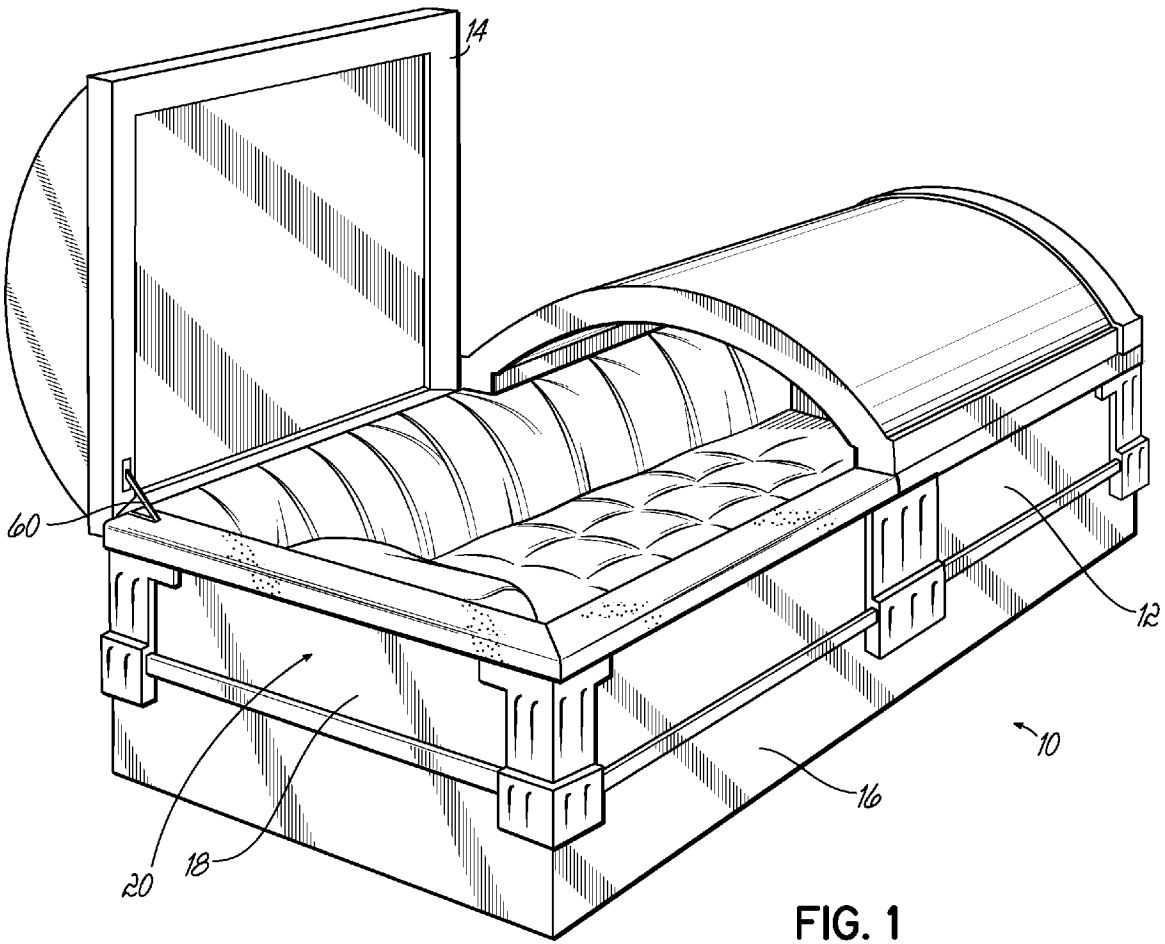

This invention relates generally to the death care industry, and more particularly to caskets and decorative treatments therefor.

BACKGROUND

Caskets, whether fabricated of wood or metal, have traditionally been provided with attractive exteriors. Finely polished wood and metal finishes are typically provided for wood and metal caskets, respectively. Further, caskets have traditionally been provided with decorative exterior hardware, for example, decorative carrying handle bars and decorative "ears" or "escutcheons" covering the attachment points of the handle bars to the casket shell. Still further, caskets are typically provided with decorative corner ornaments mounted to the corners of the casket shell.

Caskets have also traditionally been outfitted with decorative interiors. These interiors have taken the form of a decorative cap panel and peripheral puffing mounted in the underside of the casket cap or lid, a pillow, and shirred or other decorative fabric lining the interior side walls and head end end wall of the casket shell. In addition, the side wall of the casket shell opposite the hinge connection of the cap to the shell, as well as the head end end wall of the casket shell, typically carry an additional, larger, piece of shirred or other decorative fabric for overlaying the top edge of the casket shell during periods when the casket cap is opened for presentation and viewing of the deceased. The smaller decorative fabric portions which line the interior side walls and head end end wall of the casket shell are each known as a "small body," whereas the larger piece of decorative fabric which is placed over the casket shell edge during presentation and viewing is known as the "big body." The big body thus provides a means for concealing the shell upper edge or flange during presentation and viewing, presenting a finished look. In the case of "sealer" metal caskets which carry a rubber flange gasket on the shell edge to provide a seal between shell and cap, the big body conceals the gasket. Polyester or other batting material is typically included in the small and big bodies in order to provide firmness, fullness, etc.

A drawback to the traditional fabric big body is that, when deployed over the edge of the casket shell during presentation and viewing, it tends to hang down over a portion or all of the decorative escutcheons, corner ornaments and/or decorative surface, of the casket shell. It is therefore desirable to provide a decorative cover treatment for the casket shell edge, which does not conceal these decorative features of the casket shell.

Another drawback to the traditional fabric big body is that it has a bulky, dated appearance. It is therefore desirable to provide a more contemporary look to the casket by eliminating the current bulky big body.

Yet another drawback to the traditional fabric big body is that it requires time intensive, tedious manual smoothing, straightening and/or manipulation of the fabric to present the best appearance of the big body, due to the flaccid nature of the fabric. It is therefore desirable to provide a decorative cover treatment for the casket shell edge, which does not require such attention.

One innovation which addresses the above drawbacks is disclosed in the assignee's U.S. Pat. No. 7,069,267, which is hereby incorporated by reference herein. This patent discloses and claims, in one aspect, a decorative cover for a casket shell flange which is at least semi-rigid and which is no wider than the upper edge of the casket shell, and in another aspect, a decorative cover for a casket shell flange which is at least semi-rigid and which is removably secured to the shell via a press-fit connections such that the cover snaps onto the shell edge.

It is desirable to provide further innovation in the area of decorative covers for casket shell flanges.

SUMMARY

A casket comprises a shell having a pair of opposed side walls and a pair of opposed end walls, the walls defining an upwardly facing flange of the shell, a lid closeable upon the flange of the shell, and a cover removably positioned on the shell when the lid is open, the cover being constructed of a first section which overlies the flange and a second section which overlies a portion of the shell side and end walls extending downward from the flange, the first and second sections being joined along lengths thereof by a third malleable section which functions as a stave thereby permitting an angle formed between the first and second sections to be manually adjusted and set.

The first and second sections can be fabricated from polypropylene plastic. The third section can be fabricated from aluminum. Polyethylene foam can be adhered to first sides of the polypropylene plastic first and second sections. The aluminum third section can be adhered to second opposite sides of the polypropylene plastic first and second sections. The first, second, and third sections can be encapsulated in decorative fabric. The cover can be generally L-shaped, having a shell end wall portion and a shell side wall portion. The second section of the cover can overly about one inch of the shell side and end walls extending downward from the flange.

DRAWINGS

Figure 2:
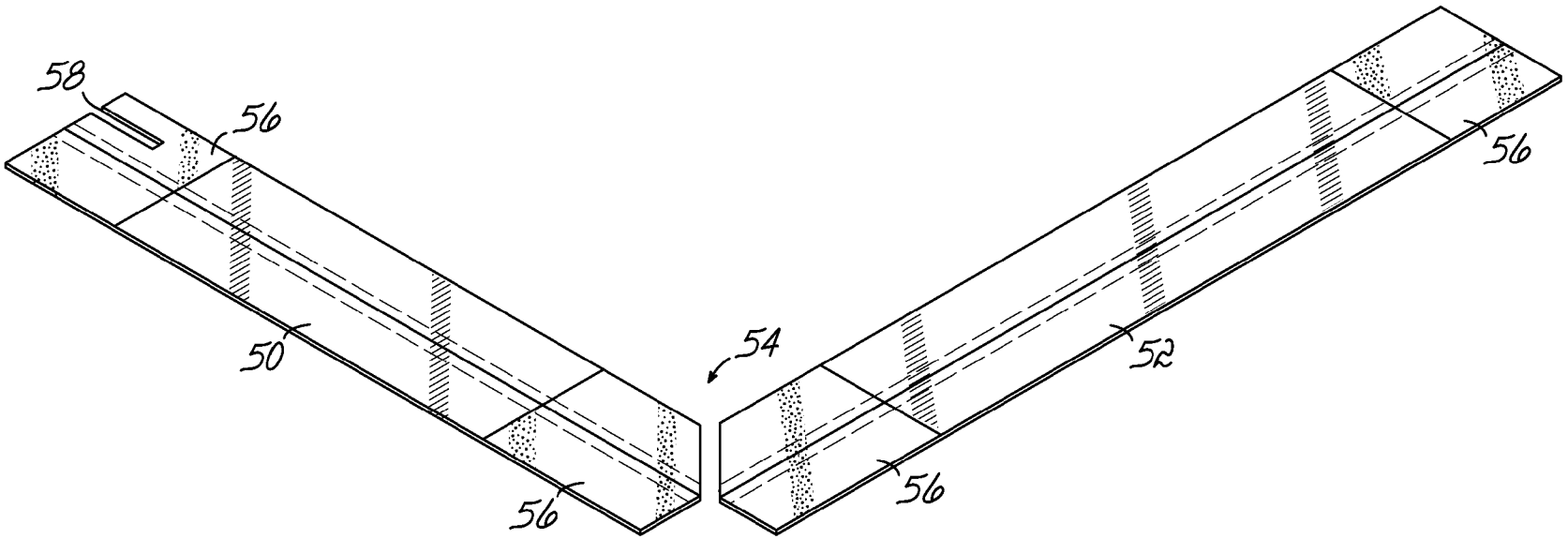
Figure 3A:
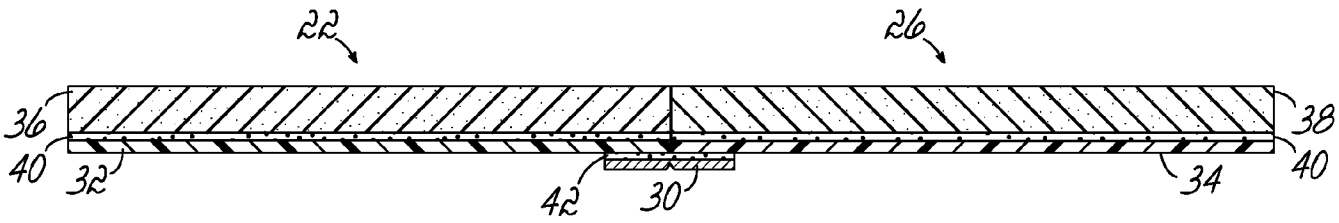
Figure 3B:
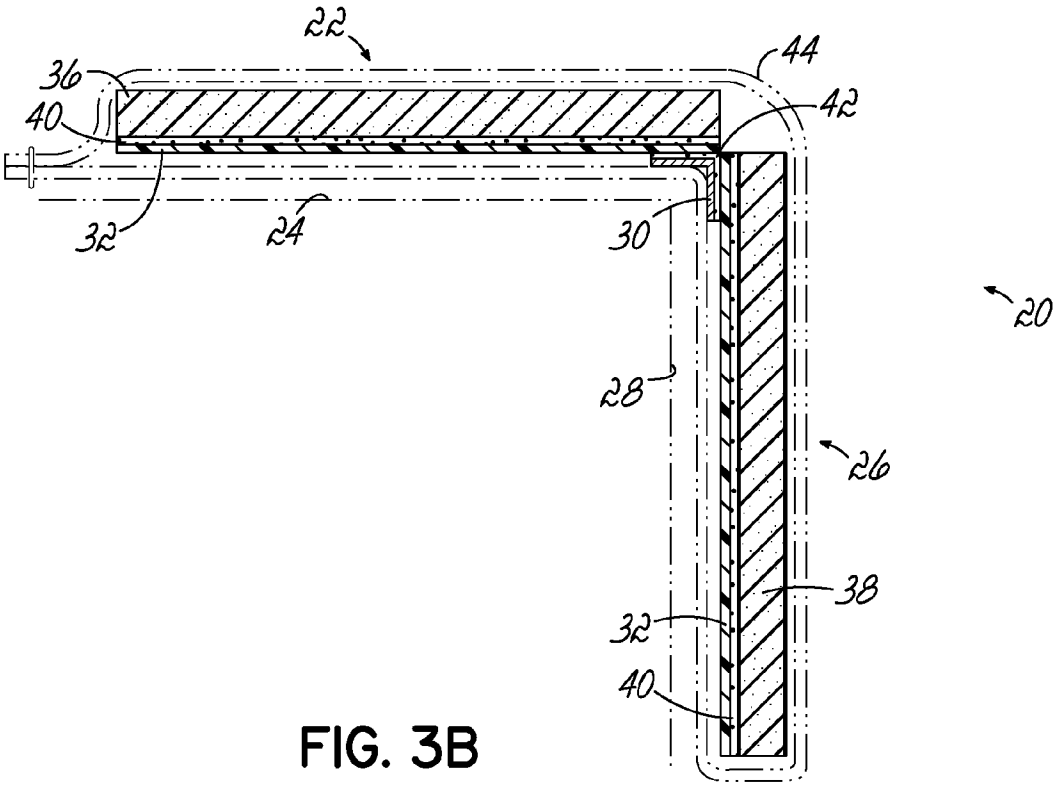

FIG. 1 is a perspective view of a casket and decorative cover for casket shell flange, FIG. 2 is a perspective view of end wall and side wall portions of a decorative cover, FIG. 3A is a cross-sectional view of the cover with the first and second portions thereof generally co-planar prior to adjusting the third section, and FIG. 3B is a view similar to FIG. 3A but with the first and second portions forming an angle therebetween of about 90 degrees relative to each other by virtue of the third section being bent about 90 degrees along its entire length.

DESCRIPTION

With reference to FIG. 1, a casket 10 has a shell 12 and at least one lid 14 closable on the shell 12. Shell 12 has a pair of oppositely disposed side walls, one of which is shown at 16, and a pair of oppositely disposed end walls, one of which is shown at 18. Decorative cover 20 for the casket shell flange is removably mounted to the shell 12.

Referring now to FIGS. 2, 3A, and 3B, the cover 20 is constructed of a first section 22 which overlies the flange 24 and a second section 26 which overlies a portion 28 of the shell side and end walls 16, 18 extending downward from the flange 24. The first and second sections 22, 26 are joined along their lengths by a third malleable section 30 which functions as a stave thereby permitting an angle formed between the first and second sections 22, 26 to be manually adjusted and set.

The first and second sections 22, 26 can be fabricated from polypropylene plastic strips 32, 34. The third section 30 can be fabricated from a malleable material such as malleable metal such as aluminum. Other malleable materials and malleable metals can be used. Polyethylene foam strips 36, 38 can be adhered to first sides of the polypropylene plastic first and second sections 22, 26 via adhesive 40. The aluminum third section 30 can be adhered to second opposite sides of the polypropylene plastic first and second sections 22, 26 via adhesive 42. The first 22, second 26, and third 30 sections can be encapsulated in decorative fabric 44. The cover can be generally L-shaped, having a shell end wall portion 50 and a shell side wall portion 52. The second section 26 of the cover 20 can overly about one inch of the shell side 16 and end 18 walls extending downward from the flange 24.

The abutting ends of the portions 50 and 52 can have a miter 54 to fit the corner of the shell 12 where the side wall 16 and end wall 18 meet. The polypropylene plastic first and second sections 22, 26 can stop about five inches short of the ends of the polyethylene foam strips 36, 38, as shown at 56, to allow the cover to fold into the shell 12. The end portion 50 can have a slot 58 formed therein to accept cap or the lid brace 60 (FIG. 1).

The embodiments shown and described are merely for illustrative purposes only. The drawings and the description are not intended to limit in any way the scope of the claims. Those skilled in the art will appreciate various changes, modifications, and alternative embodiments. All such changes, modifications and embodiments are deemed to be embraced by the claims.

The invention claimed is:

1. A casket comprising:

a shell having a pair of opposed side walls and a pair of opposed end walls, said walls defining an upwardly facing flange of said shell, a lid closeable upon said flange of said shell, and a cover removably positioned on said shell when said lid is open, said cover being constructed of a first section which overlies said flange and a second section which overlies a portion of said shell side and end walls extending downward from said flange, said first and second sections being joined along lengths thereof by a third malleable section which functions as a stave thereby permitting an angle formed between said first and second sections to be manually adjusted and set.

2. The casket of claim 1 wherein said first and second sections are fabricated from polypropylene plastic.

3. The casket of claim 2 wherein said third section is fabricated from aluminum.

4. The casket of claim 1 wherein said first and second sections are fabricated from polypropylene plastic to which is adhered, on first sides of said first and second sections, polyethylene foam.

5. The casket of claim 4 wherein said third section is fabricated from aluminum and is adhered to said polypropylene plastic of said first and second sections on second opposite sides of said first and second sections.

6. The casket of claim 5 wherein said first, second, and third sections are encapsulated in decorative fabric.

7. The casket of claim 1 wherein said cover is generally L-shaped, having a shell end wall portion and a shell side wall portion.

8. The casket of claim 1 wherein said cover second section overlies about one inch of said shell side and end walls extending downward from said flange.

* * * * *